US009236205B2

(12) United States Patent
Hsu et al.

(10) Patent No.: US 9,236,205 B2
(45) Date of Patent: Jan. 12, 2016

(54) KEYSWITCH AND KEYBOARD THEREOF

(71) Applicants: DARFON ELECTRONICS (SUZHOU) CO., LTD., Suzhou, Jiangsu Province (CN); DARFON ELECTRONICS CORP., Taoyuan (TW)

(72) Inventors: Chien-Shih Hsu, Taoyuan (TW); Zuei-Chown Jou, Taoyuan (TW); Ching-Chuan Chang, Taoyuan (TW)

(73) Assignees: DARFON ELECTRONICS (SUZHOU) CO., LTD., New District, Suzhou, Jiangsu Province (CN); DARFON ELECTRONICS CORP., Gueishan, Taoyuan (TW)

( * ) Notice: Subject to any disclaimer, the term of this patent is extended or adjusted under 35 U.S.C. 154(b) by 207 days.

(21) Appl. No.: 14/185,886

(22) Filed: Feb. 20, 2014

(65) Prior Publication Data

US 2014/0231234 A1 Aug. 21, 2014

(30) Foreign Application Priority Data

Feb. 21, 2013 (TW) ..... 102106098 A

(51) Int. Cl.

| | |
|---|---|
| ***H01H 13/70*** | (2006.01) |
| ***H01H 13/52*** | (2006.01) |
| ***H01H 13/7065*** | (2006.01) |
| ***H01H 3/12*** | (2006.01) |

(Continued)

(52) U.S. Cl.

CPC ..... *H01H 13/52* (2013.01); *H01H 3/122* (2013.01); *H01H 5/02* (2013.01); *H01H 13/7065* (2013.01); *H01H 3/125* (2013.01); *H01H 13/83* (2013.01); *H01H 2003/506* (2013.01); *H01H 2215/00* (2013.01); *H01H 2219/044* (2013.01); *H01H 2219/062* (2013.01); *H01H 2221/04* (2013.01)

(58) Field of Classification Search

CPC ..... H01H 3/122; H01H 3/125; H01H 3/503; H01H 3/506; H01H 2221/04

USPC ..... 200/341, 344, 404

See application file for complete search history.

(56) References Cited

U.S. PATENT DOCUMENTS

| | | | |
|---|---|---|---|
| 3,644,856 | A | 2/1972 | Scott |
| 4,453,148 | A | 6/1984 | Norakidze |

(Continued)

FOREIGN PATENT DOCUMENTS

| | | |
|---|---|---|
| TW | M254664 | 1/2005 |
| TW | M389337 | 9/2010 |

(Continued)

*Primary Examiner* — Felix O Figueroa

(74) *Attorney, Agent, or Firm* — Winston Hsu; Scott Margo

(57) ABSTRACT

A keyswitch includes a cap, a board, first and second support members rotatably connected to the cap and the board, a seesaw member, and a magnetic member. The seesaw member movably supports at least one of the cap and the first and second support members. The magnetic member is disposed on the board corresponding to the seesaw member. When the cap is pressed, the at least one of the cap and the first and second support members drives the seesaw member to raise and the cap moves from a non-pressed position to a pressed position. When the cap is released, a magnetic attraction force between the magnetic member and the seesaw member drives the seesaw member to raise for lifting the at least one of the cap and the first and second support members, so as to move the cap back to the non-pressed position.

26 Claims, 17 Drawing Sheets

(51) Int. Cl.

| | |
|---|---|
| ***H01H 5/02*** | (2006.01) |
| *H01H 3/50* | (2006.01) |
| *H01H 13/83* | (2006.01) |

(56) References Cited

U.S. PATENT DOCUMENTS

| | | | | |
|---|---|---|---|---|
| 4,689,608 | A | 8/1987 | Bolda | |
| 5,977,888 | A * | 11/1999 | Fujita et al. | 200/5 A |
| 6,392,515 | B1 * | 5/2002 | Van Zeeland et al. | 335/205 |
| 6,670,873 | B2 | 12/2003 | Inada | |
| 6,761,494 | B2 | 7/2004 | Hsu | |
| 8,970,331 | B2 * | 3/2015 | Chang et al. | 200/341 |
| 2012/0169603 | A1 | 7/2012 | Peterson | |
| 2013/0126323 | A1 | 5/2013 | Hsu | |

FOREIGN PATENT DOCUMENTS

| | | |
|---|---|---|
| TW | M416801 | 11/2011 |
| TW | M434979 | 8/2012 |

* cited by examiner

KEYSWITCH AND KEYBOARD THEREOF

BACKGROUND OF THE INVENTION

1. Field of the Invention

The present invention relates to a keyswitch and a keyboard thereof, and more specifically, to a keyswitch utilizing a magnetic attraction force between a seesaw member and a board as a driving force for driving a cap to return back to a non-pressed position and a keyboard thereof.

2. Description of the Prior Art

A keyboard, which is the most common input device, could be found in variety of electronic apparatuses for users to input characters, symbols, numerals and so on. Furthermore, from consumer electronic products to industrial machine tools, they are all equipped with a keyboard for performing input operations.

Please refer to FIG. 1, which is a sectional diagram of a keyswitch 1 according to the prior art. As shown in FIG. 1, the keyswitch 1 includes aboard 10, a cap 12, a circuit board 14, a support device 16, and an elastic member 18. The circuit board 14 is disposed on the board 10. The support device 16 is disposed between the cap 12 and the board 10 for supporting the cap 12. The elastic member 18 is also disposed between the cap 12 and the board 10. Accordingly, when the cap 12 is pressed by a user, the elastic member 18 could provide cap 12 with an elastic force to make the cap 12 return back to a non-pressed position.

However, since the scissor mechanical design adopted by the support device 16 requires more space so as to further increase the overall height of the keyswitch 1, it is disadvantageous to the thinning design of the keyswitch 1. Furthermore, because the elastic member 18 is usually made of rubber material, elastic fatigue of the elastic member 18 may occur after the elastic member 18 is used over a long period of time so as to shorten the life of the keyswitch 1.

SUMMARY OF THE INVENTION

An objective of the present invention is to provide a keyswitch utilizing a magnetic attraction force between a seesaw member and a board as a driving force for driving a cap to return back to a non-pressed position and a keyboard thereof for solving the aforesaid problem.

According to an embodiment of the present invention, a keyswitch includes a cap, a board, a first support member, a second support member, a seesaw member, and a magnetic member. The first support member is rotatably connected to the cap and rotatably connected to the board for rotating around a first rotating shaft on the board. The second support member is rotatably connected to the cap and rotatably connected to the board. The cap moves between a non-pressed position and a pressed position relative to the board with rotation of the first support member and the second support member. The seesaw member has a pressing arm portion, a magnetic arm portion, and a fulcrum portion. The seesaw member movably supports at least one of the cap, the first support member and the second support member. The fulcrum member is connected to the pressing arm portion and the magnetic arm portion and rotatably connected to the board. The seesaw member rotates around a second rotating shaft on the board. The second support member rotates around a third rotating shaft on the board. The magnetic member is disposed on the board corresponding to the magnetic arm portion. When the cap is pressed by an external force and the external force could overcome a magnetic attraction force between the magnetic member and the magnetic arm portion, the at least one of the cap, the first support member and the second support member moves downward to abut against the pressing arm portion for making the seesaw member rotate around the fulcrum portion, so that the magnetic arm portion could be driven to raise relative to the board and the cap could move from the non-pressed position to the pressed position. When the cap is released, the magnetic attraction force between the magnetic member and the magnetic arm portion drives the seesaw member to rotate around the fulcrum portion and then be absorbed onto the magnetic member for making the pressing arm portion raise relative to the board, so that the pressing arm portion could lift the at least one of the cap, the first support member and the second support member to make the cap move from the pressing position back to the non-pressed position.

According to another embodiment of the present invention, a keyboard includes a board and a plurality of keyswitches. The plurality of keyswitches is disposed on the board. At least one of the plurality of keyswitches includes a cap, a first support member, a second support member, a seesaw member, and a magnetic member. The first support member is rotatably connected to the cap and rotatably connected to the board. The second support member is rotatably connected to the cap and rotatably connected to the board. The cap moves between a non-pressed position and a pressed position relative to the board with rotation of the first support member and the second support member. The seesaw member has a pressing arm portion, a magnetic arm portion, and a fulcrum portion. The seesaw member movably supports at least one of the cap, the first support member, and the second support member. The fulcrum member is connected to the pressing arm portion and the magnetic arm portion and rotatably connected to the board. The magnetic member is disposed on the board corresponding to the magnetic arm portion. When the cap is pressed by an external force and the external force could overcome a magnetic attraction force between the magnetic member and the magnetic arm portion, the at least one of the cap, the first support member, and the second support member moves downward to abut against the pressing arm portion to make the seesaw member rotate around the fulcrum portion, so that the magnetic arm portion could be driven to raise relative to the board and the cap could be moved from the non-pressed position to the pressed position. When the cap is released, the magnetic attraction force between the magnetic member and the magnetic arm portion drives the seesaw member to rotate around the fulcrum portion and then be absorbed onto the magnetic member for making the pressing arm portion raise relative to the board, so that the pressing arm portion could lift the at least one of the cap, the first support member and the second support member to make the cap move from the pressing position back to the non-pressed position.

According to another embodiment of the present invention, a keyboard includes a board and a plurality of keyswitches. The plurality of keyswitches is disposed on the board. At least one of the plurality of keyswitches includes a cap, a first support member, a seesaw member, and an attraction member. The first support member is rotatably connected to the cap and rotatably connected to the board for rotating around a first rotating shaft on the board. The cap moves between a non-pressed position and a pressed position relative to the board. The seesaw member has a pressing arm portion, an attraction arm portion, and a fulcrum portion. The pressing arm portion movably supports at least one of the cap and the first support member. The fulcrum member is connected to the pressing arm portion and the attraction arm portion and rotatably connected to the board to make the seesaw member rotate around a second rotating shaft on the board. The attraction member is disposed on the board corresponding to the attraction arm portion. When the cap is pressed by an external force and the external force could overcome a magnetic attraction force between the attraction member and the attraction arm portion, the pressing arm portion rotates around the fulcrum portion, so that the attraction arm portion could be driven to raise relative to the board and the cap could move from the non-pressed position to the pressed position with rotation of the first support member. When the cap is released, the magnetic attraction force between the attraction member and the attraction arm portion drives the attraction arm portion to rotate around the fulcrum portion and then be absorbed onto the attraction member for making the pressing arm portion raise relative to the board, so that the cap could move from the pressing position back to the non-pressed position with rotation of the first support member.

In summary, since there is no scissor mechanism and elastic member disposed in the keyboard provided by the present invention, the present invention could greatly reduce the overall space occupied by the keyswitch, so as to be advantageous to the thinning design of the keyboard and effectively prolong the life of the keyswitch.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
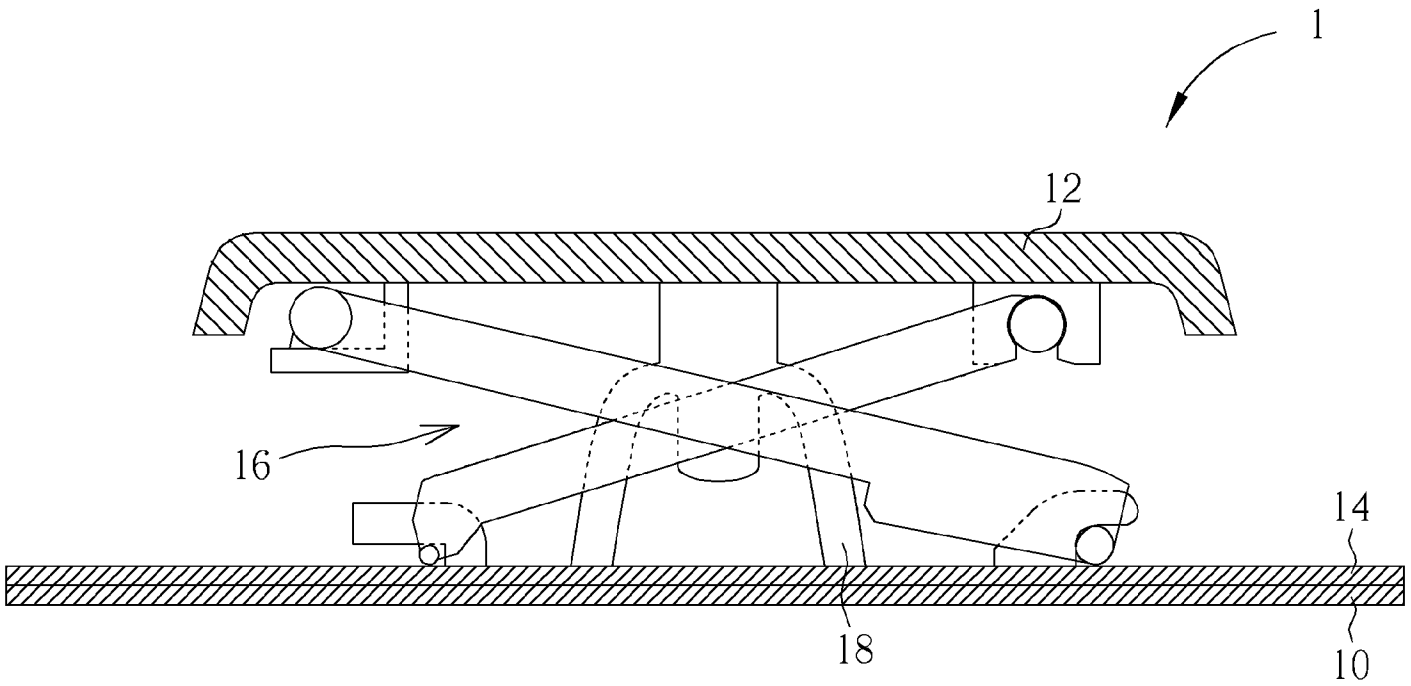
FIG. 1 PRIOR ART
FIG. 1 is a sectional diagram of a keyswitch according to the prior art.
Figure 2:
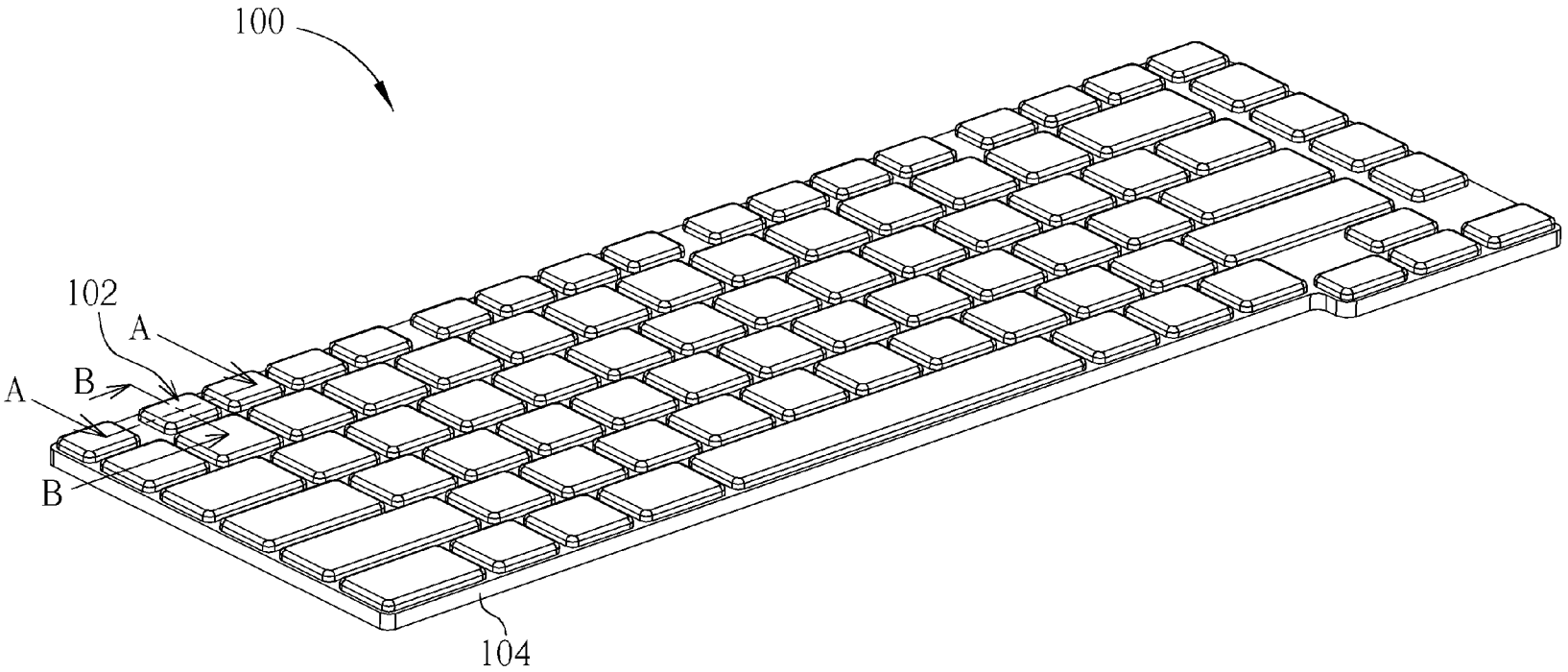
FIG. 2 is a diagram of a keyboard according to a first embodiment of the present invention.

Please refer to FIG. 2, which is a diagram of a keyboard 100 according to a first embodiment of the present invention. As shown in FIG. 2, the keyboard 100 includes a plurality of keyswitches 102 and a board 104. The plurality of keyswitches 102 is disposed on the board 104 for a user to perform input operations. The keyboard 100 could be preferably a keyboard conventionally applied to a personal computer, but not limited thereto. For example, the keyboard could also be applied to a portable electronic device with a foldable mechanism composed of an upper cover and a lower casing (e.g. a notebook or a foldable keyboard).

Figure 3:
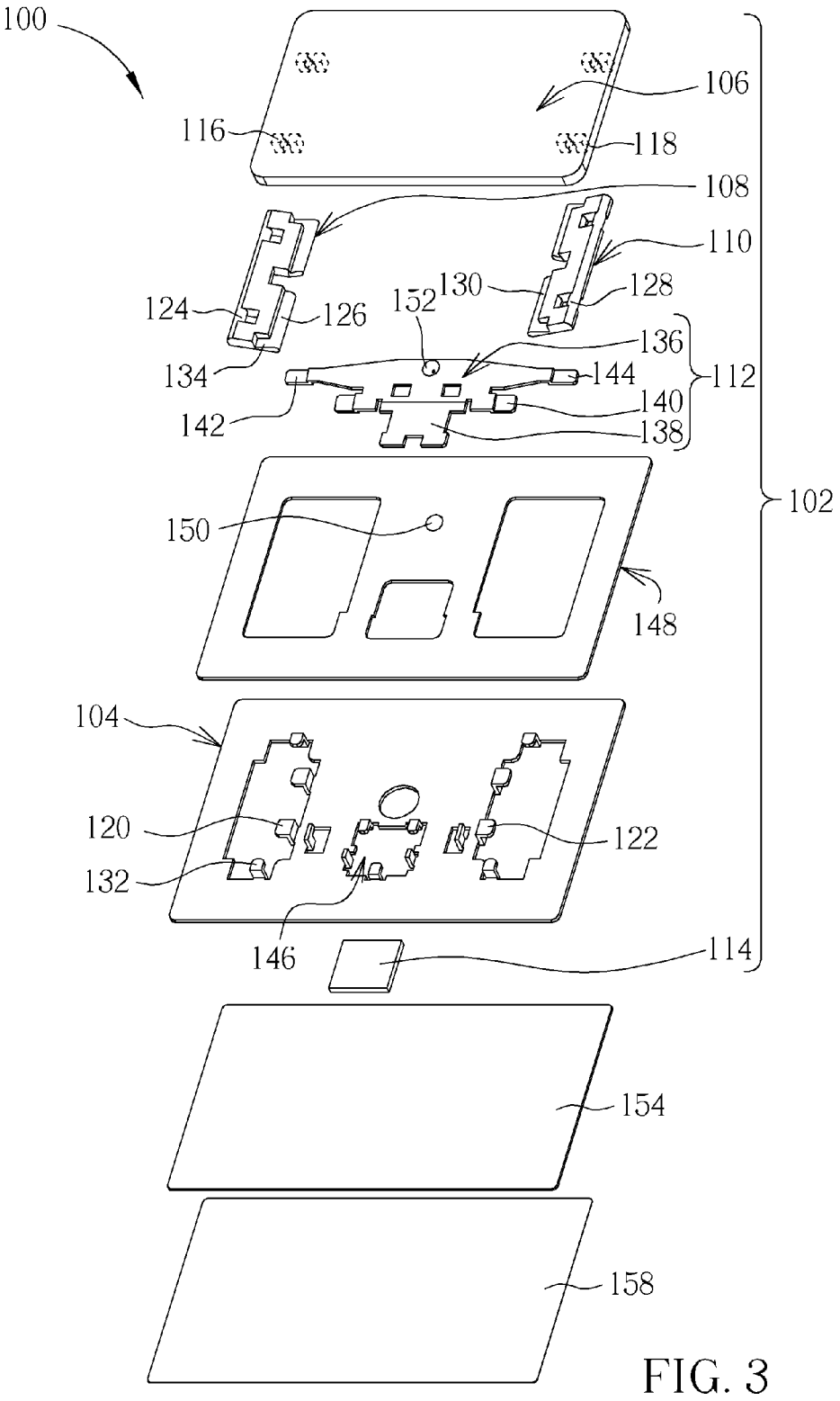
FIG. 3 is a partial exploded diagram of the keyboard in FIG. 2.
Figure 4:
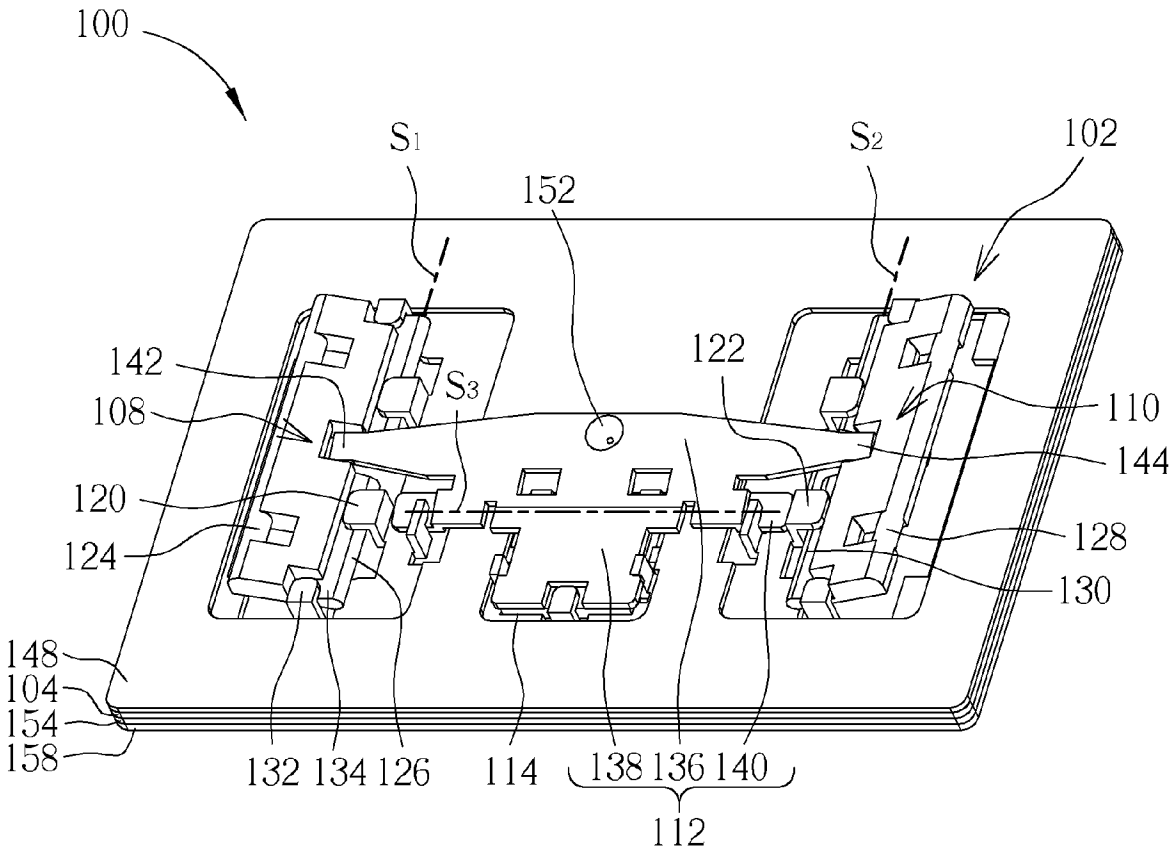
FIG. 4 is an assembly diagram of a keyswitch in FIG. 2 being assembled on a board.
Figure 5:
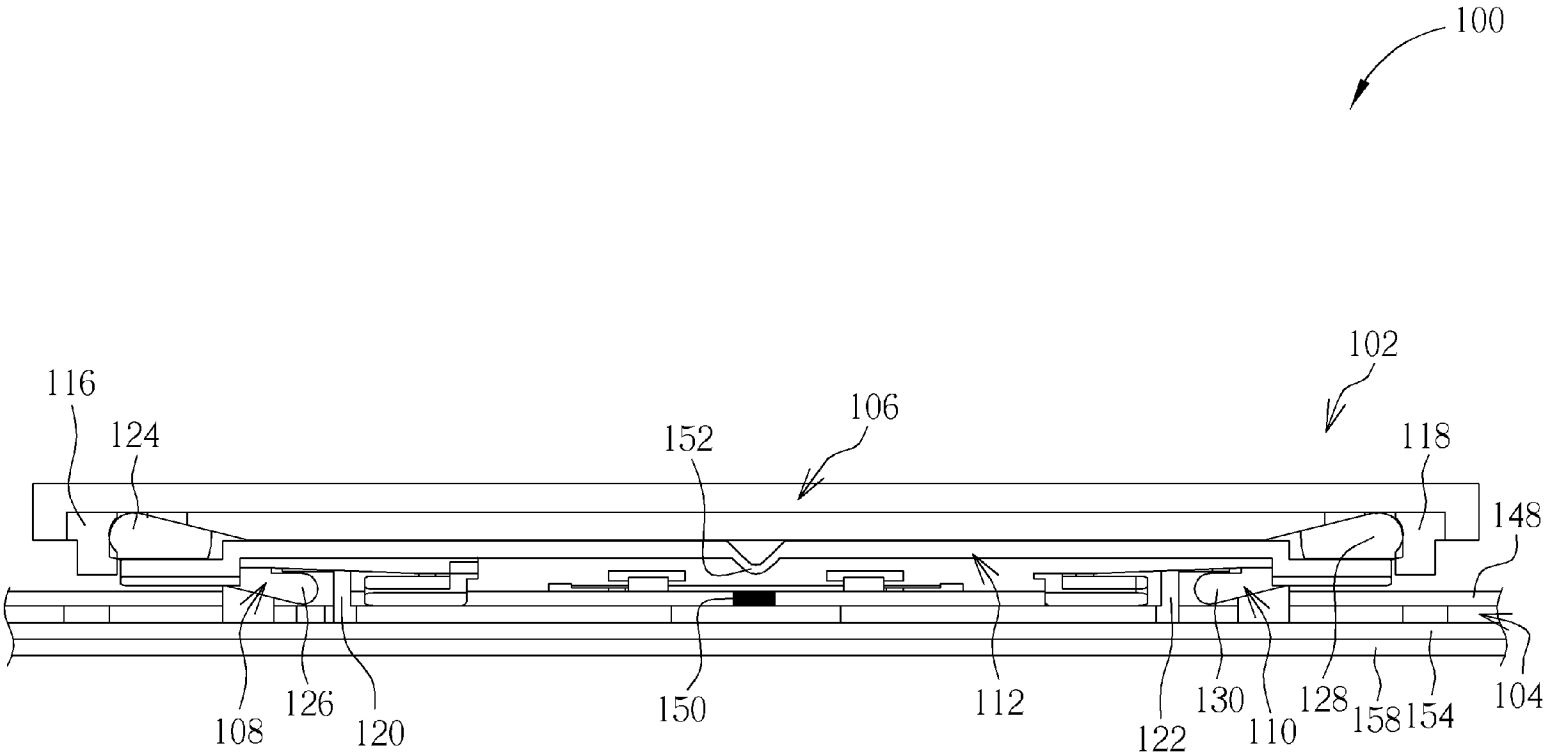
FIG. 5 is a sectional diagram of the keyswitch in FIG. 2 along a sectional line A-A.
Figure 6:
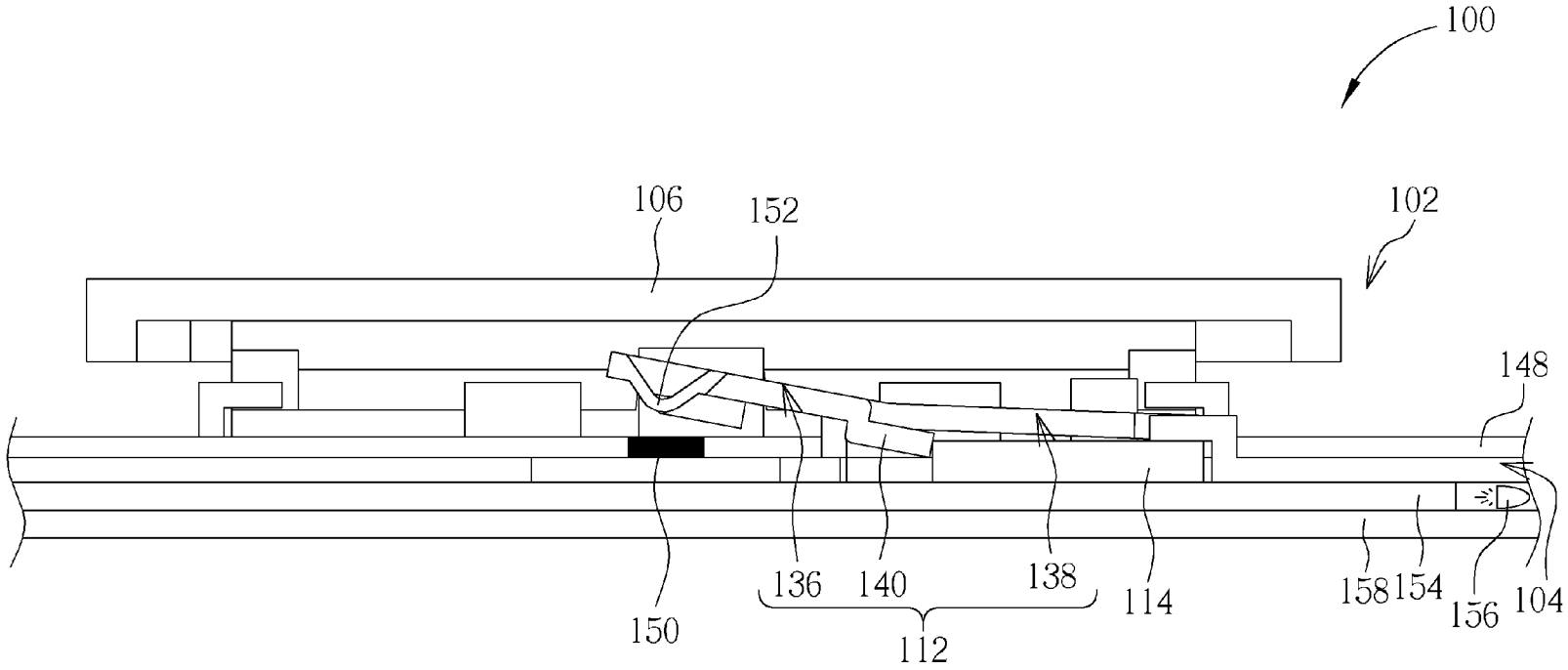
FIG. 6 is a sectional diagram of the keyswitch in FIG. 2 along a sectional line B-B.

In the present invention, the design for utilizing a magnetic attraction force to drive the keyswitch to return back to a non-pressed position could be applied to at least one of the plurality of keyswitches 102. In the following, more detailed description for only one keyswitch 102 to which the aforesaid design is applied is provided. As for the related description for other keyswitches 102 utilizing the same design, it could be reasoned by analogy. Please refer to FIG. 3, FIG. 4, FIG. 5, and FIG. 6. FIG. 3 is a partial exploded diagram of the keyboard 100 in FIG. 2. FIG. 4 is an assembly diagram of the keyswitch 102 in FIG. 2 being assembled on the board 104. FIG. 5 is a sectional diagram of the keyswitch 102 in FIG. 2 along a sectional line A-A. FIG. 6 is a sectional diagram of the keyswitch 102 in FIG. 2 along a sectional line B-B. For clearly showing the structural design of the keyswitch 102, a cap 106 is omitted in FIG. 4. As shown in FIG. 3 and FIG. 4, the keyswitch 102 includes the cap 106, a first support member 108, a second support member 110, a seesaw member 112, and a magnetic member 114. The first support member 108 is rotatably connected to the cap 106 and rotatably connected to the board 104, so that the first support member 108 could rotate around a rotating shaft $S_1$. The second support member 110 is rotatably connected to the cap 106 and rotatably connected to the board 104, so that the second support member 110 could rotate around a rotating shaft $S_2$.

More detailed description for the structural designs of the cap 106, the first support member 108, and the second support member 110 is provided as follow. The cap 106 has a first engaging slot 116 and a second engaging slot 118. The board 104 has a first sliding slot 120 and a second sliding slot 122. The first support member 108 has a first pivot shaft 124 and a first connecting shaft 126. The second support member 110 has a second pivot shaft 128 and a second connecting shaft 130. The first connecting shaft 126 and the second connecting shaft 130 could be movably disposed in the first sliding slot 120 and the second sliding slot 122 respectively and the first pivot shaft 124 and the second pivot shaft 128 could be pivoted to the first engaging slot 116 and the second engaging slot 118 respectively, so that the first support member 108 and the second support member 110 could be assembled with the cap 106 and the board 104. Accordingly, via the aforesaid connection design, the cap 106 could move between a non-pressed position and a pressed position relative to the board 104 with rotation of the first support member 108 and the second support member 110. Furthermore, the board 104 could further have a limiting arm portion 132 and the first support member 108 could have a limiting block 134 corresponding to the limiting block 132. The limiting arm portion 132 is used for blocking the limiting block 134 so as to limit a height of the cap 106 relative to the board 104.

As shown in FIG. 3 and FIG. 4, the seesaw member 112 has a pressing arm portion 136, a magnetic arm portion 138, and a fulcrum portion 140. In this embodiment, the pressing arm portion 136 movably abuts against the first support member 108 and the second support member 110. To be more specific, the pressing arm portion 136 could have a first abutting end 142 and a second abutting end 144. The first abutting end 142 abuts against the first pivot shaft 124 of the first support member 108 but is not directly connected to the cap 106. The second abutting end 144 abuts against the second pivot shaft 128 of the second support member 110 but is not directly connected to the cap 106. The fulcrum portion 140 is connected to the pressing arm portion 136 and the magnetic arm portion 138. The fulcrum portion 140 is rotatably connected to the board 104 so that the fulcrum portion 140 could rotate around a rotating shaft $S_3$. Accordingly, the fulcrum portion 140 could form a T-shaped seesaw mechanism cooperatively with the pressing arm portion 136 and the magnetic arm portion 138 to make the pressing arm portion 136 located between the first support member 108 and the second support member 110. The rotating shaft $S_1$ of the first support member 108 is substantially parallel to the rotating shaft $S_2$ of the second support member 110 and is perpendicular to the rotating shaft $S_3$ of the seesaw member 112, so as to be arranged in a U-shape cooperatively with the rotating shaft $S_2$ of the second support member 110 and the rotating shaft $S_3$ of the seesaw member 112 on the board 104 (as shown in FIG. 4).

Furthermore, the magnetic member 114 is disposed on the board 104 corresponding to the magnetic arm portion 138. In this embodiment, the magnetic member 114 could be preferably a magnet, and the magnetic arm portion 138 could be preferably a magnet or be made of magnetic material (e.g. iron or other metal material). In another embodiment, the magnetic member 114 could be made of magnetic material (e.g. iron or other metal material), and the magnetic arm portion 138 could be a magnet. In practical application, the board 104 could have an opening 146 corresponding to the magnetic arm portion 138. The magnetic member 114 could be disposed in the opening 146 for reducing the overall height of the keyboard 100.

As for the triggering design of the keyswitch 102, it could be as shown in FIG. 5 and FIG. 6. In this embodiment, the keyboard 100 could further include a circuit board 148 disposed on the board 104. The circuit board 148 could be preferably a membrane and have a switch 150 (e.g. a membrane switch or other triggering switch), and the pressing arm portion 136 could has a protruding point 152 corresponding to the switch 150. Accordingly, the protruding point 152 could trigger the switch 150 for executing the corresponding input function when the cap 106 moves to the pressed position. In practical application, the pressing arm portion 136 could be made of magnetic material, and the magnetic member 114 could extend toward the pressing arm portion 136 to be partially overlapped with the pressing arm portion 136. Accordingly, the distance between the pressing arm portion 136 and the magnetic member 114 could decrease with downward movement of the cap 106 when the cap 106 is pressed by an external force to make the pressing arm portion 136 approach the magnetic member 114. Since the magnetic attraction force between the pressing arm portion 136 and the magnetic member 114 is inversely proportional to the square of the distance between the pressing arm portion 136 and the magnetic member 114, the magnetic attraction force between the pressing arm portion 136 and the magnetic member 114 could increase to drive the pressing arm portion 136 to move downward quickly, so that the cap 106 could speed up to the pressed position for providing the user with a preferable pressing feeling.

Furthermore, as shown in FIG. 6, the keyboard 100 could further include a light guide plate 154 and at least one light emitting unit 156 (one shown in FIG. 6, but not limited thereto). The light guide plate 154 is disposed under the board 104. The light emitting unit 156 could be preferably an LED (Light Emitting Diode) and be disposed at a side of the light guide plate 154 for emitting light out of the cap 106 via the light guide plate 154. The keyboard 100 could adopt a conventional light emitting design. For example, the board 104 could have a plurality of openings (not shown in figures), so that light emitted by the light emitting unit 156 could pass through the aforesaid openings via the light guide plate 154 and then be emitted out of the cap 106. In such a manner, the keyboard 100 could have an illumination function. Furthermore, in practical application, the keyboard 100 could further include a magnetic plate 158. The magnetic plate 158 is disposed under the board 104 for reducing the magnetic influence of the magnetic member 114 to other circuitry located under the board 104 (e.g. the circuitry of the notebook).

Figure 7:
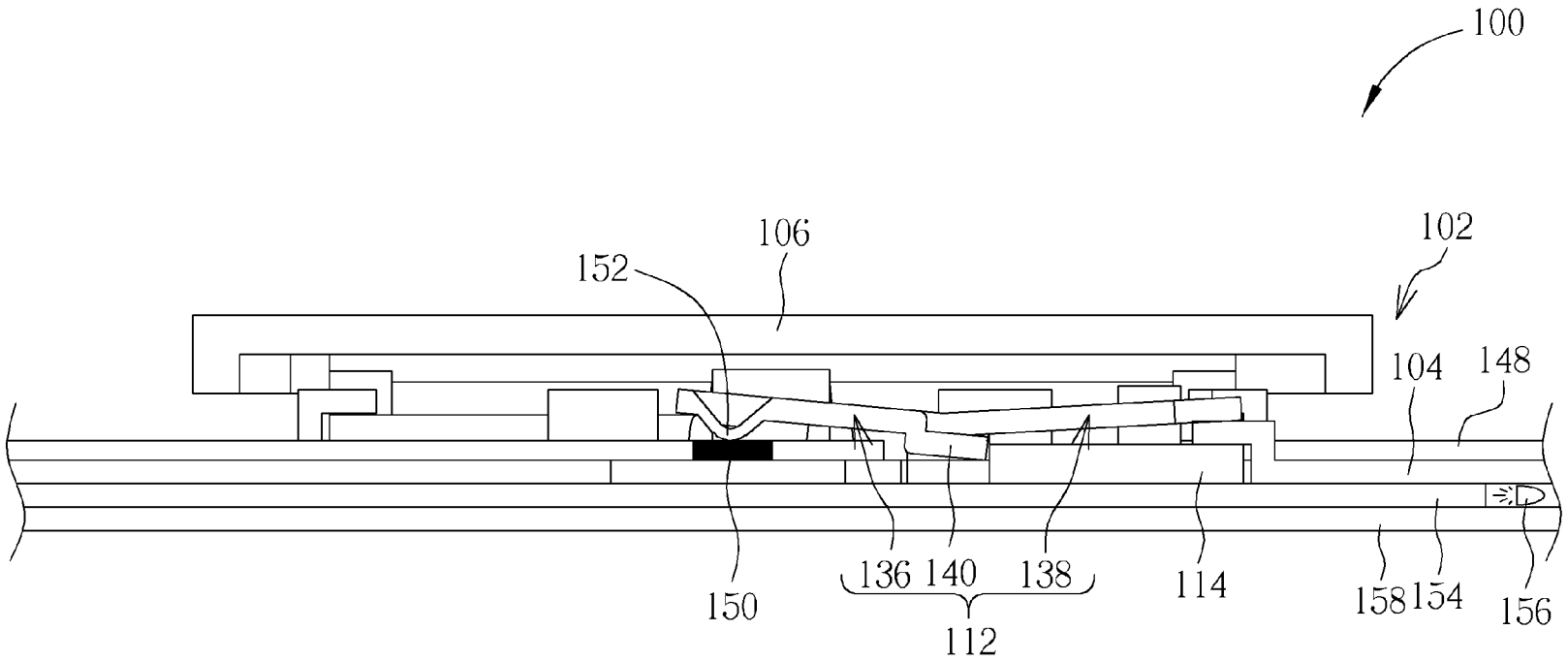
FIG. 7 is a sectional diagram of a cap in FIG. 6 being pressed.

Via the aforesaid design, the magnetic member 114 could be absorbed onto the magnetic arm portion 138 when the cap 106 is not pressed (as shown in FIG. 4, FIG. 6, and FIG. 7). That is, the magnetic attraction force between the magnetic member 114 and the magnetic arm portion 138 could drive the seesaw member 112 to rotate around the fulcrum portion 140 for making the pressing arm portion 136 raise relative to the board 104 (as shown in FIG. 4). In such a manner, the pressing arm portion 136 could utilize the first abutting end 142 and the second abutting end 144 to lift the first support member 108 and the second support member 110 so as to support the cap 106 at the non-pressed position as shown in FIG. 6. When the cap 106 is pressed by an external force and the external force could overcome the magnetic attraction force between the magnetic member 114 and the magnetic arm portion 138, the cap 106 presses the first support member 108 and the second support member 110 and abuts against the pressing arm portion 136 via the first abutting end 142 and the second abutting end 144, so as to make the seesaw member 112 rotate around the fulcrum portion 140. In such a manner, the magnetic arm portion 138 could be driven to raise relative to the board 104 and the cap 106 could move from the non-pressed position as shown in FIG. 6 to the pressed position as shown in FIG. 7, so as to make the protruding point 152 of the pressing arm portion 136 trigger the switch 150 of the circuit board 148 for executing the corresponding input function.

On the other hand, when the cap 106 is released, the magnetic attraction force between the magnetic member 114 and the magnetic arm portion 138 could attract the magnetic arm portion 138 to drive the seesaw member 112 to rotate around the fulcrum portion 140, so that the magnetic arm portion 138 could be driven to move from the position as shown in FIG. 7 to the position as shown in FIG. 6 and then be absorbed onto the magnetic member 114. During aforesaid process, the pressing arm portion 136 could drive the first support member 108 and the second support member 110 to move the cap 106 from the pressed position back to the non-pressed position as shown in FIG. 6 for achieving the purpose that the keyswitch 102 could automatically return back to its original position.

Figure 8:
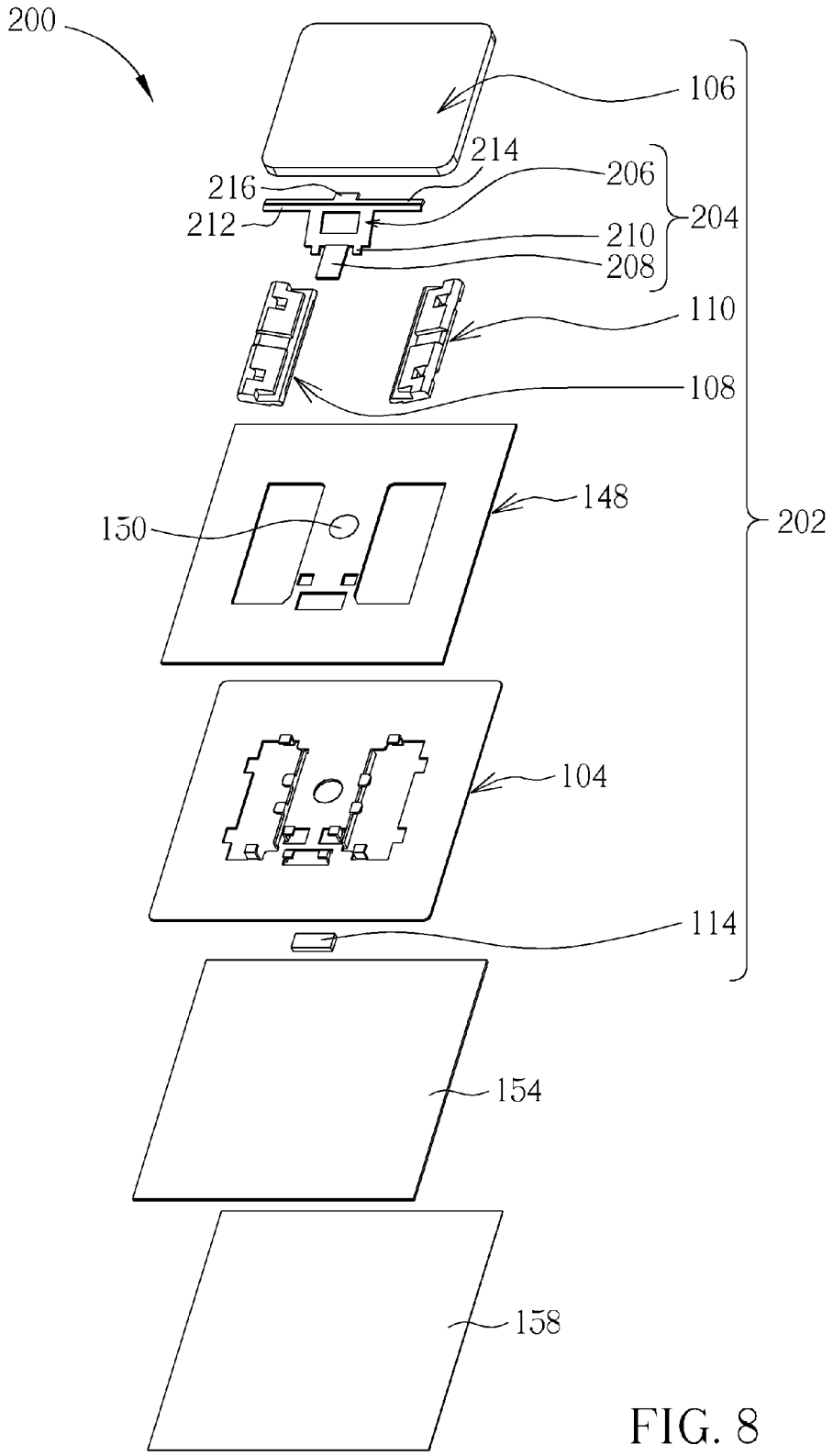
FIG. 8 is a partial exploded diagram of a keyboard according to a second embodiment of the present invention.
Figure 9:
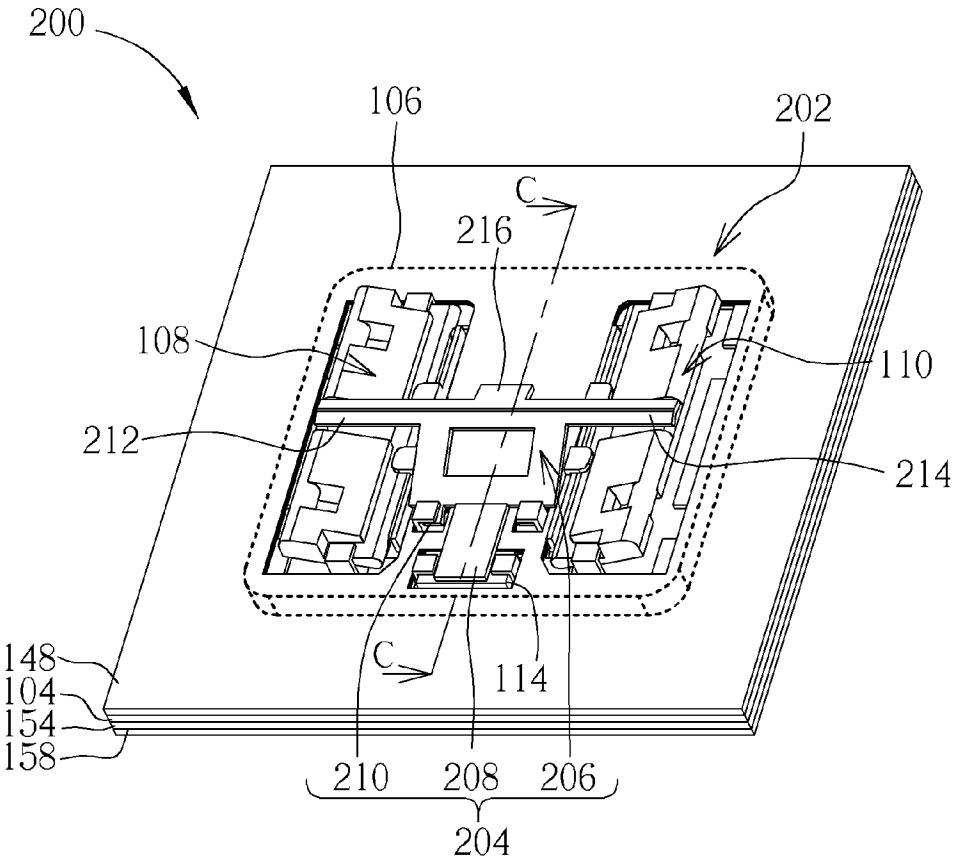
FIG. 9 is an assembly diagram of a keyswitch in FIG. 8 being assembled on the board.
Figure 10:
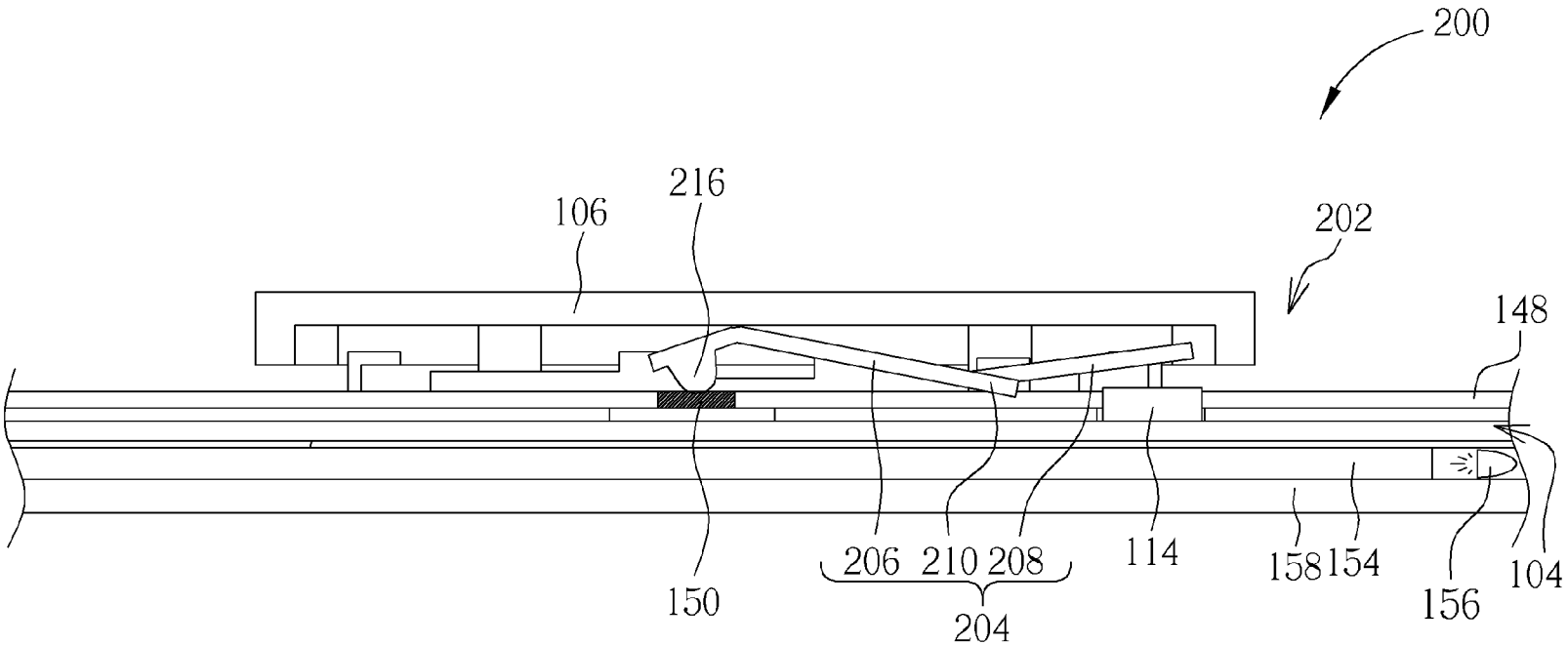
FIG. 10 is a sectional diagram of the keyswitch in FIG. 9 along a sectional line C-C.

It should be mentioned that the abutting design for the seesaw member with the cap, the first support member, and the second support member is not limited to the aforesaid embodiment. That is, the present invention could also adopt the design in which the seesaw member is movably connected to the cap, the first support member, and the second support member, the design in which the seesaw member only abuts against the cap but is not directly connected to the first support member and the second support member, or the design in which the two ends of the seesaw member abut against the first support member (or the second support member) and the cap respectively. For example, please refer to FIG. 8, FIG. 9, and FIG. 10. FIG. 8 is a partial exploded diagram of a keyboard 200 according to a second embodiment of the present invention. FIG. 9 is an assembly diagram of a keyswitch 202 in FIG. 8 being assembled on the board 104. FIG. 10 is a sectional diagram of the keyswitch 202 in FIG. 9 along a sectional line C-C. For clearly showing the structural design of the keyswitch 202, the cap 106 is depicted by dotted lines in FIG. 9. Components both mentioned in the second embodiment and the first embodiment represent components with similar functions or structures, and the related description is omitted herein. As shown in FIG. 8, the keyboard 200 includes the board 104, the circuit board 148, the light guide plate 154, the magnetic plate 158, and the keyswitch 202. The keyswitch 202 includes the cap 106, the first support member 108, the second support member 110, the magnetic member 114, and a seesaw member 204.

As shown in FIG. 8 and FIG. 9, the seesaw member 204 has a pressing arm portion 206, a magnetic arm portion 208, and a fulcrum portion 210. In this embodiment, the pressing arm portion 206 movably abuts against the cap 106. To be more specific, the pressing arm portion 206 could have a first abutting end 212 and a second abutting end 214. The first abutting end 212 is located between the cap 106 and the first support member 108 to abut against the cap 106 but is not connected to the first support member 108. The second abutting end 214 is located between the cap 106 and the second support member 110 to abut against the cap 106 but is not directly connected to the second support member 110. The fulcrum portion 210 is connected to the pressing arm portion 206 and the magnetic arm portion 208. The fulcrum portion 210 is rotatably connected to the board 104 so that the fulcrum portion 210 could form a T-shaped seesaw mechanism cooperatively with the pressing arm portion 206 and the magnetic arm portion 208 to make the pressing arm portion 206 located between the first support member 108 and the second support member 110. In practical application, the pressing arm portion 206 could be made of magnetic material, and the magnetic member 114 could extend toward the pressing arm portion 206 to be partially overlapped with the pressing arm portion 206. Accordingly, the distance between the pressing arm portion 206 and the magnetic member 114 could decrease with downward movement of the cap 106 when the cap 106 is pressed by an external force to make the pressing arm portion 206 approach the magnetic member 114. Since the magnetic attraction force between the pressing arm portion 206 and the magnetic member 114 is inversely proportional to the square of the distance between the pressing arm portion 206 and the magnetic member 114, the magnetic attraction force between the pressing arm portion 206 and the magnetic member 114 could increase to drive the pressing arm portion 206 to move downward quickly, so that the cap 106 could speed up to the pressed position for providing the user with a preferable pressing feeling.

Via the aforesaid design, as shown in FIG. 9 and FIG. 10, when the cap 106 is pressed by an external force and the external force could overcome the magnetic attraction force between the magnetic member 114 and the magnetic arm portion 208, the cap 106 could directly press the pressing arm portion 206 to drive the seesaw member 204 to rotate around the fulcrum portion 210 for making the magnetic arm portion 208 raise relative to the board 104. With downward movement of the cap 106, the pressing arm portion 206 could utilize the first abutting end 212 and the second abutting end 214 to press the first support member 108 and the second support member 110 respectively to rotate. In such a manner, the cap 106 could move to the pressed position as shown in FIG. 10 with rotation of the first support member 108 and the second support member 110, so that a protruding point 216 of the pressing arm portion 206 could trigger the switch 150 of the circuit board 148 for executing the corresponding input function. On the other hand, when the cap 106 is released, the cap 106 could return back to the non-pressed position automatically. During this process, the pressing arm portion 206 could drive the cap 106 to move the first support member 108 and the second support member 110, so that the cap 106 could automatically move back to the non-pressed position as shown in FIG. 9. As for the other related description for the keyswitch 202, it could be reasoned by analogy according to the first embodiment and therefore omitted herein.

Figure 11:
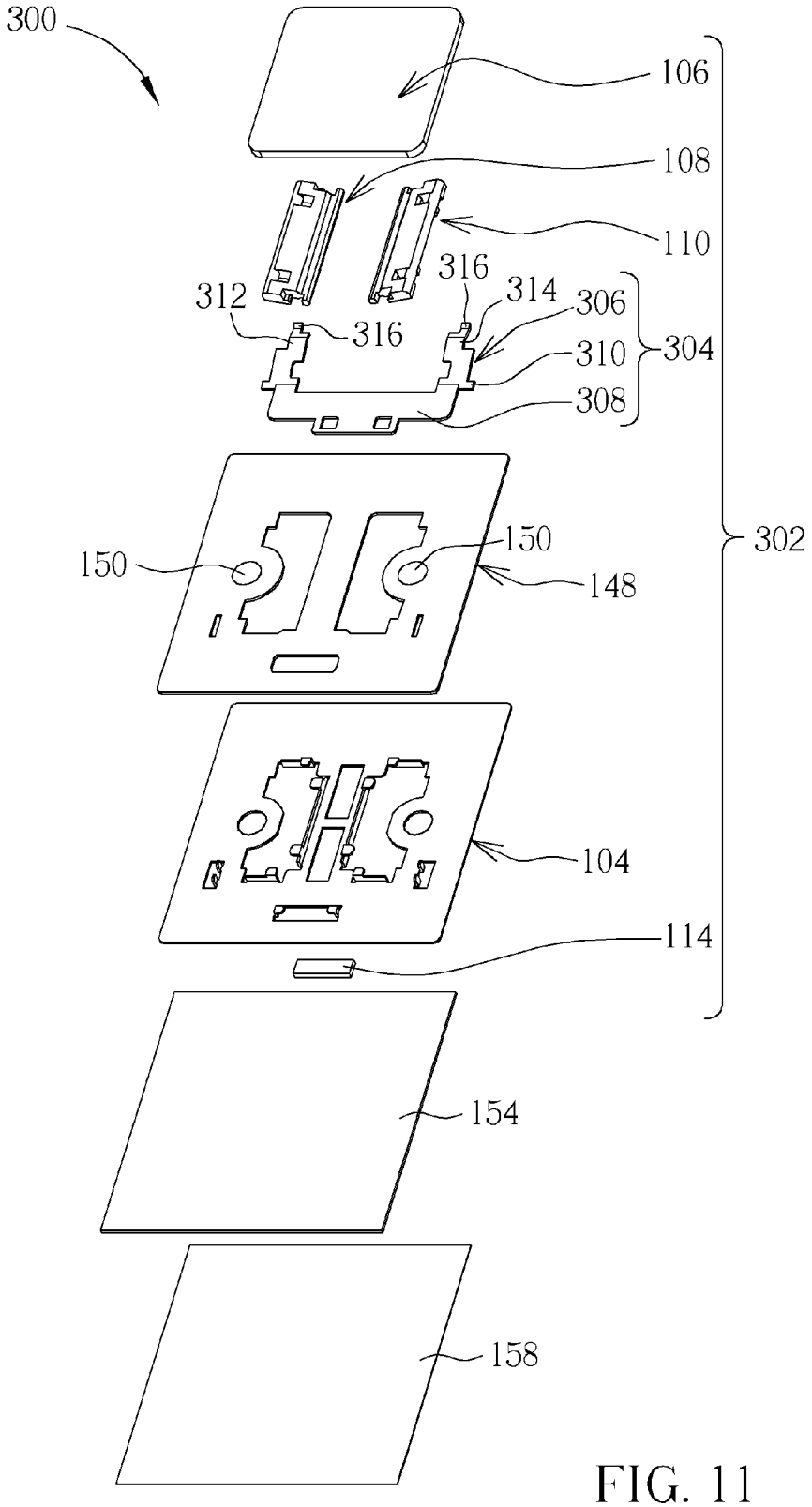
FIG. 11 is a partial exploded diagram of a keyboard according to a third embodiment of the present invention.
Figure 12:
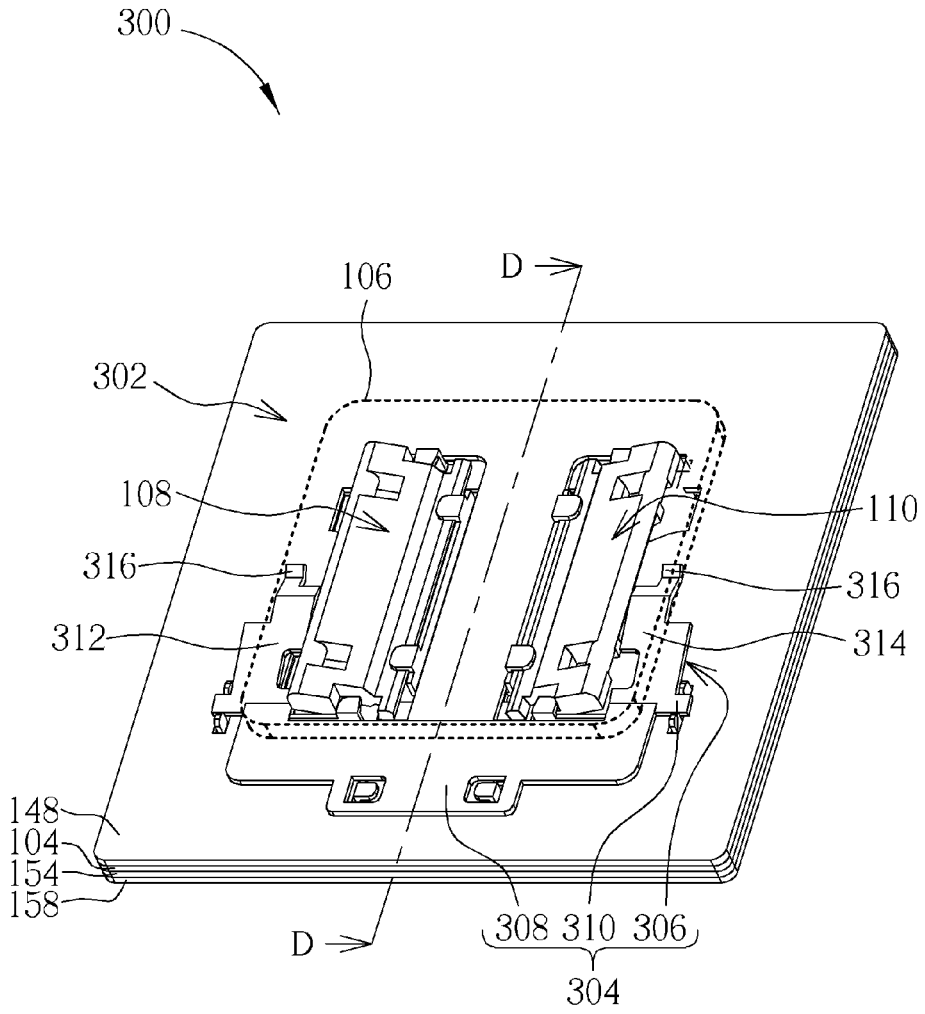
FIG. 12 is an assembly diagram of a keyswitch in FIG. 11 being assembled on the board.
Figure 13:
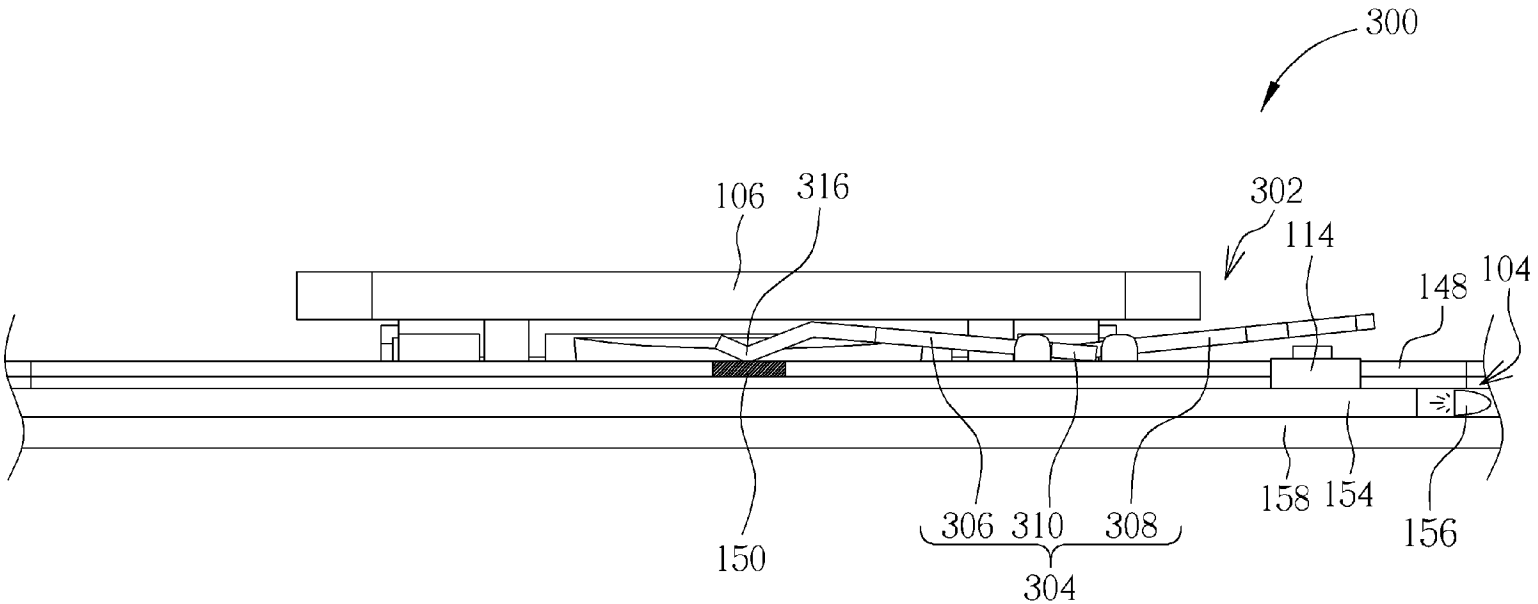
FIG. 13 is a sectional diagram of the keyswitch in FIG. 12 along a sectional line D-D.

Please refer to FIG. 11, FIG. 12, and FIG. 13. FIG. 11 is a partial exploded diagram of a keyboard 300 according to a third embodiment of the present invention. FIG. 12 is an assembly diagram of a keyswitch 302 in FIG. 11 being assembled on the board 104. FIG. 13 is a sectional diagram of the keyswitch 302 in FIG. 12 along a sectional line D-D. For clearly showing the structural design of the keyswitch 302, the cap 106 is depicted by dotted lines in FIG. 12. Components both mentioned in the third embodiment and the first embodiment represent components with similar functions or structures, and the related description is omitted herein. As shown in FIG. 11, the keyboard 300 includes the board 104, the circuit board 148, the light guide plate 154, the magnetic plate 158, and the keyswitch 302. The keyswitch 302 includes the cap 106, the first support member 108, the second support member 110, the magnetic member 114, and a seesaw member 304.

As shown in FIG. 11 and FIG. 12, the seesaw member 304 has a pressing arm portion 306, a magnetic arm portion 308, and a fulcrum portion 310. In this embodiment, the pressing arm portion 306 movably abuts against the cap 106. To be more specific, the pressing arm portion 306 could have a first abutting end 312 and a second abutting end 314. The first abutting end 312 is located outside the first support member 108 to abut against the cap 106. The second abutting end 314 is located outside the second support member 110 to abut against the cap 106. The fulcrum portion 310 is connected to the pressing arm portion 306 and the magnetic arm portion 308. The fulcrum portion 310 is rotatably connected to the board 104 so that the fulcrum portion 310 could form a U-shaped seesaw mechanism cooperatively with the pressing arm portion 306 and the magnetic arm portion 308 to make the pressing arm portion 306 located outside the first support member 108 and the second support member 110. In practical application, the first abutting end 312 could be made of magnetic material, and the magnetic member 114 could extend toward the first abutting end 312 to be partially overlapped with the first abutting end 312. Accordingly, the distance between the pressing arm portion 306 and the magnetic member 114 could decrease with downward movement of the cap 106 when the cap 106 is pressed by an external force to make the pressing arm portion 306 approach the magnetic member 114. Since the magnetic attraction force between the pressing arm portion 306 and the magnetic member 114 is inversely proportional to the square of the distance between the pressing arm portion 306 and the magnetic member 114, the magnetic attraction force between the pressing arm portion 306 and the magnetic member 114 could increase to drive the pressing arm portion 306 to move downward quickly, so that the cap 106 could speed up to the pressed position for providing the user with a preferable pressing feeling. The aforesaid design could be also applied to the structural design of the second abutting end 314, and the related description could be reasoned by analogy according to the aforesaid description and therefore omitted herein.

Via the aforesaid design, as shown in FIG. 12 and FIG. 13, when the cap 106 is pressed by an external force and the external force could overcome the magnetic attraction force between the magnetic member 114 and the magnetic arm portion 308, the cap 106 could directly press the first abutting end 312 and the second abutting end 314 of the pressing arm portion 306 to drive the seesaw member 304 to rotate around the fulcrum portion 310 for making the magnetic arm portion 308 raise relative to the board 104. With downward movement of the cap 106, the first support member 108 and the second support member 110 could be pressed directly by the cap 106 to rotate. In such a manner, the cap 106 could move to the pressed position as shown in FIG. 13 with rotation of the first support member 108 and the second support member 110, so that protruding points 316 of the first abutting end 312 and the second abutting end 314 of the pressing arm portion 306 could trigger the switch 150 of the circuit board 148 for executing the corresponding input function. As for the other related description for the keyswitch 302, it could be reasoned by analogy according to the first embodiment and omitted herein.

Figure 14:
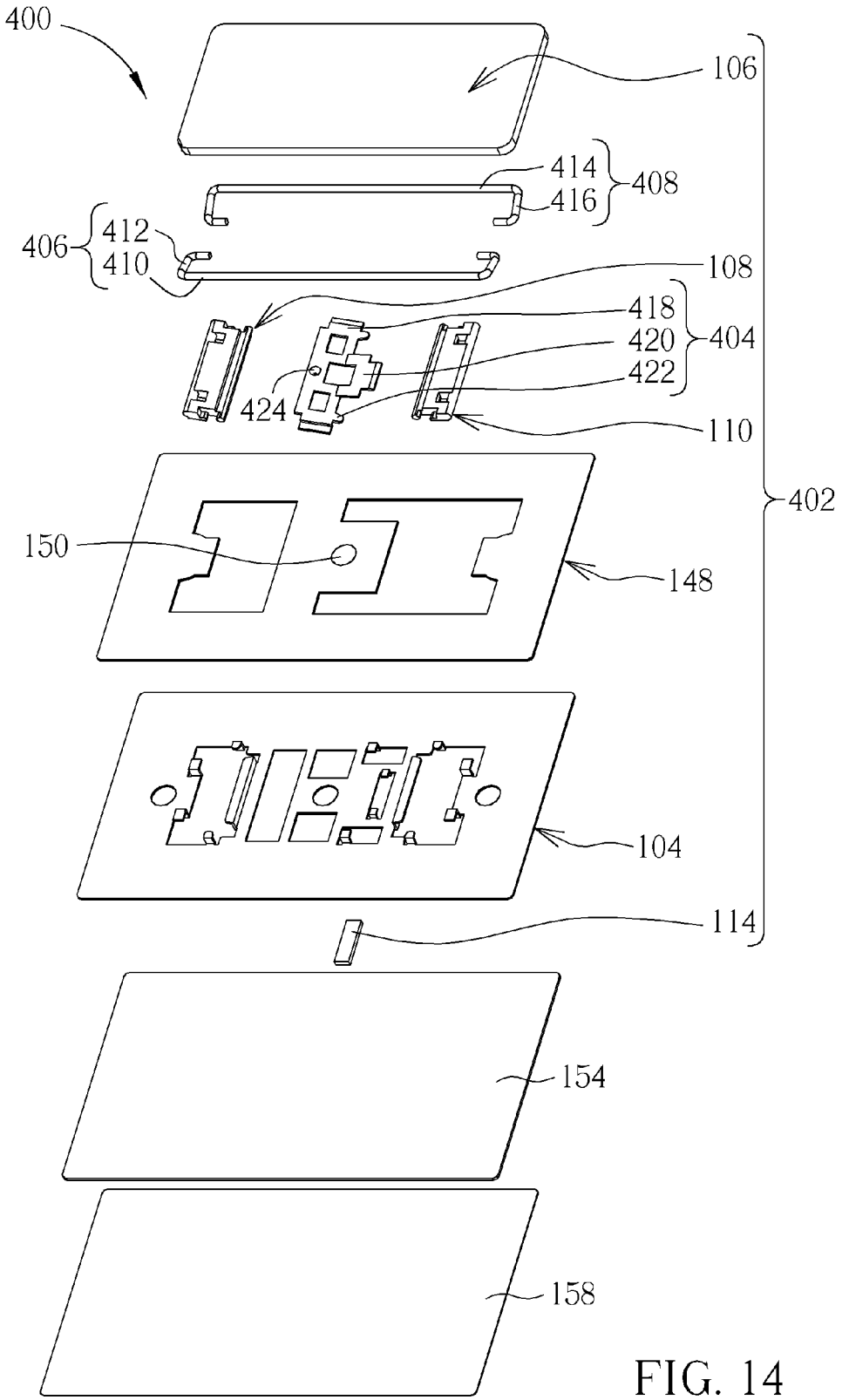
FIG. 14 is a partial diagram of a keyboard according to a fourth embodiment of the present invention.
Figure 15:
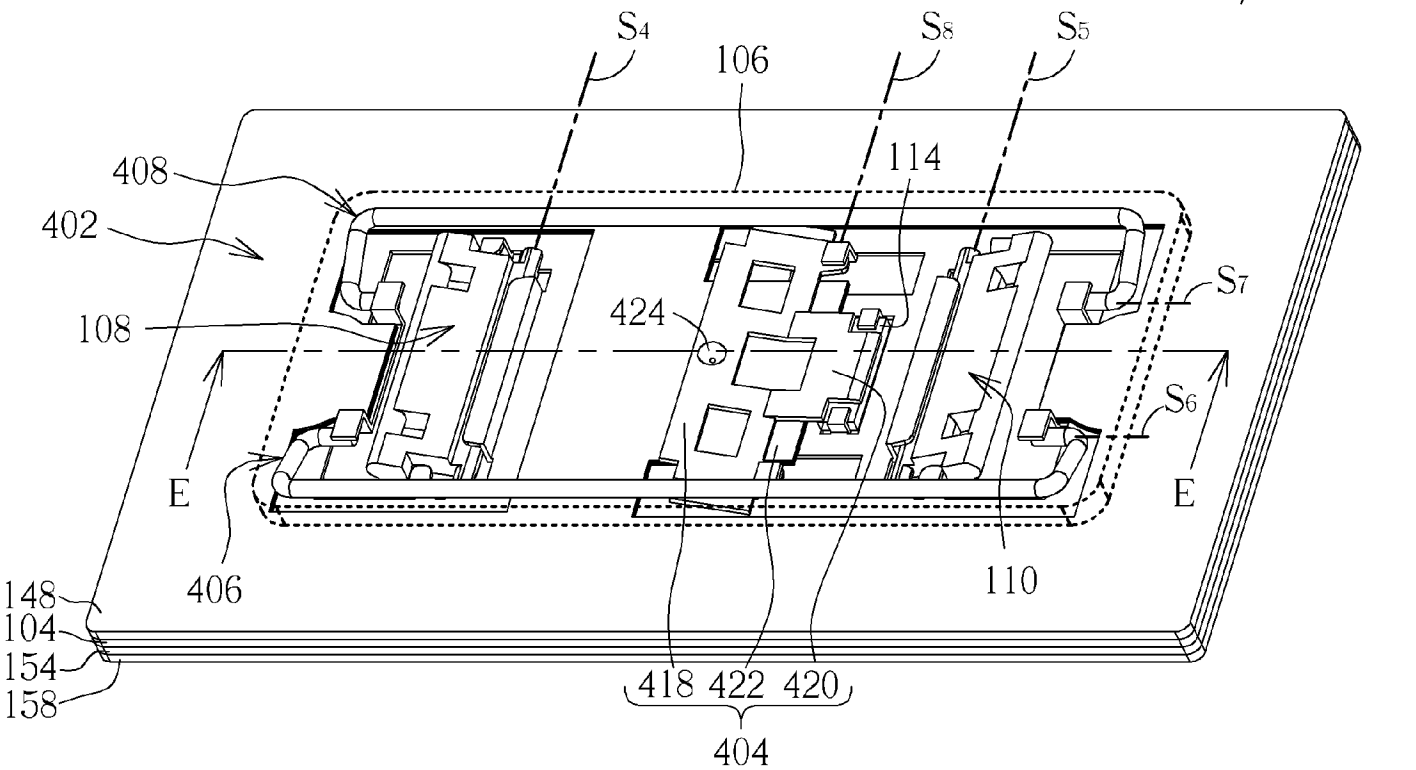
FIG. 15 is an assembly diagram of a keyswitch in FIG. 14 being assembled on the board.
Figure 16:
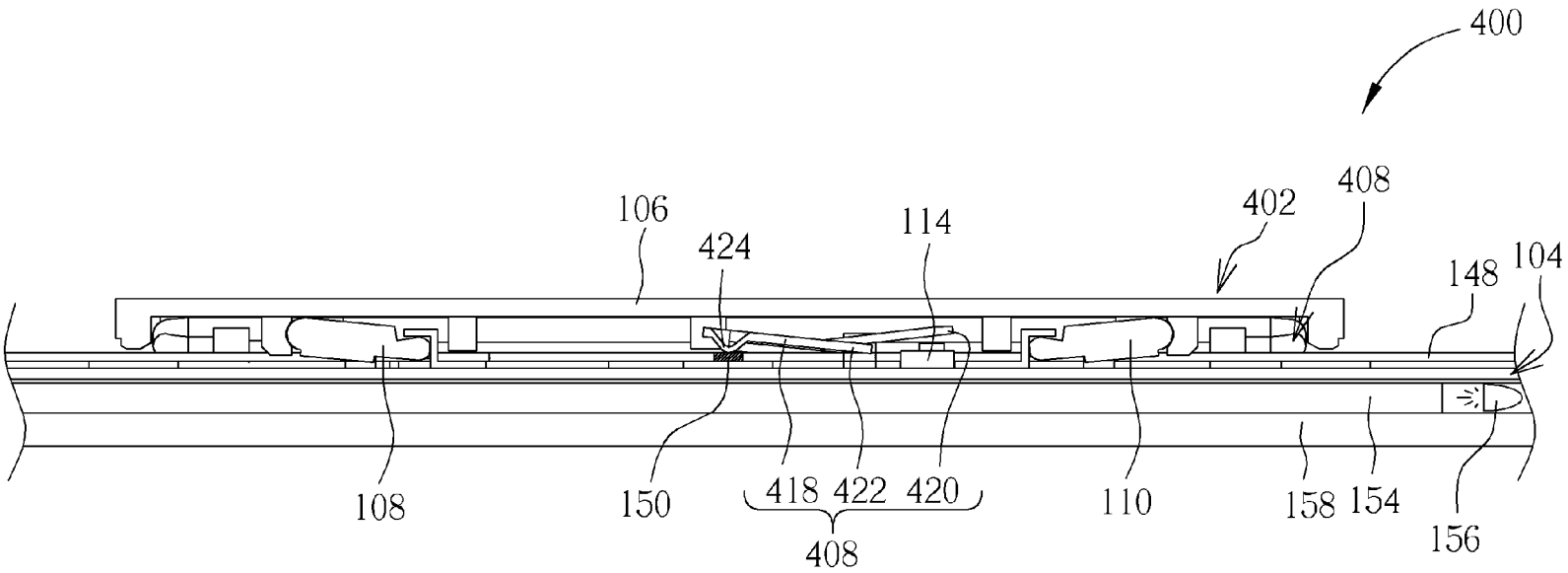
FIG. 16 is a sectional diagram of the keyswitch in FIG. 15 along a sectional line E-E.

The aforesaid arrangement design for the rotating shafts of the seesaw member, the first support member, the second support member is not limited to the U-shape design mentioned in the first embodiment, the second embodiment, and the third embodiment. For example, please refer to FIG. 14, FIG. 15, and FIG. 16. FIG. 14 is a partial diagram of a keyboard 400 according to a fourth embodiment of the present invention. FIG. 15 is an assembly diagram of a keyswitch 402 in FIG. 14 being assembled on the board 104. FIG. 16 is a sectional diagram of the keyswitch 402 in FIG. 15 along a sectional line E-E. For clearly showing the structural design of the keyswitch 402, the cap 106 is depicted by dotted lines in FIG. 15. Components both mentioned in the fourth embodiment and the first embodiment represent components with similar functions or structures, and the related description is omitted herein. As shown in FIG. 14, the keyboard 400 includes the board 104, the circuit board 148, the light guide plate 154, the magnetic plate 158, and the keyswitch 402. The keyswitch 402 includes the cap 106, the first support member 108, the second support member 110, the magnetic member 114, and a seesaw member 404. The first support member 108 is rotatably connected to the cap 106 and the board 104, so that the first support member 108 could rotate around a rotating shaft $S_4$ on the board 104. The second support member 110 is rotatably connected to the cap 106 and the board 104, so that the second support member 110 could rotate around a rotating shaft $S_5$ on the board 104.

As shown in FIG. 14 and FIG. 15, the cap 106 could include a first linkage member 406 and a second linkage member 408. The first linkage member 406 has a first transverse rod portion 410 and a first bending rod portion 412. The second linkage member 408 has a second transverse rod portion 414 and a second bending rod portion 416. The first transverse rod portion 410 and the second transverse rod portion 414 are pivoted to the cap 106 respectively. The first bending rod portion 412 and the second bending rod portion 416 are pivoted to the board 104 respectively. Accordingly, the first linkage member 406 and the second linkage member 408 could rotate around a rotating shaft $S_6$ and a rotating shaft $S_7$ respectively. Via the aforesaid linkage design, an external force could be exerted upon the cap 106 evenly via the first linkage member 408 and the second linkage member 410, so as to effectively prevent deflection of the cap 106 when the cap 106 is pressed by the external force. To be noted, the aforesaid linkage design could be also applied to other embodiments of the present invention.

In this embodiment, the seesaw member 404 has a pressing arm portion 418, a magnetic arm portion 420, and a fulcrum portion 422. As shown in FIG. 15, the pressing arm portion 418 movably abuts against the first transverse rod portion 410 of the first linkage member 406 and the second transverse rod portion 412 of the second linkage member 408. The fulcrum portion 422 is connected to the pressing arm portion 418 and the magnetic arm portion 420 and rotatably connected to the board 104, so that the seesaw member 404 could rotate around a rotating shaft $S_8$ on the board 104. Accordingly, the fulcrum portion 422 could form a T-shaped seesaw mechanism cooperatively with the pressing arm portion 418 and the magnetic arm portion 420. In this embodiment, the rotating shaft $S_8$ of the seesaw member 404 is parallel to the rotating shaft $S_4$ of the first support member 108 and the rotating shaft $S_5$ of the second support member 110, and the rotating shaft $S_6$ of the first linkage member 406 (the rotating shaft $S_7$ of the second linkage member 408), the rotating shaft $S_4$ of the first support member 108, and the rotating shaft $S_5$ of the second support member 110 are arranged in a U-shape on the board 104. In practical application, the pressing arm portion 418 could be made of magnetic material, and the magnetic member 114 could extend toward the pressing arm portion 418 to be partially overlapped with the pressing arm portion 418. Accordingly, the distance between the pressing arm portion 418 and the magnetic member 114 could decrease with downward movement of the cap 106 when the cap 106 is pressed by an external force to make the pressing arm portion 418 approach the magnetic member 114. Since the magnetic attraction force between the pressing arm portion 418 and the magnetic member 114 is inversely proportional to the square of the distance between the pressing arm portion 418 and the magnetic member 114, the magnetic attraction force between the pressing arm portion 418 and the magnetic member 114 could increase to drive the pressing arm portion 418 to move downward quickly, so that the cap 106 could speed up to the pressed position for providing the user with a preferable pressing feeling.

Via the aforesaid design, as shown in FIG. 15 and FIG. 16, when the cap 106 is pressed by an external force and the external force could overcome the magnetic attraction force between the magnetic member 114 and the magnetic arm portion 420, the cap 106 could press the first transverse rod portion 410 of the first linkage member 406 and the second transverse rod portion 414 of the second linkage member 408 to make the pressing arm portion 418 abutting against the first transverse rod portion 410 and the second transverse rod portion 414 move downward. Accordingly, the seesaw member 404 could be driven to rotate around the fulcrum portion 422 for making the magnetic arm portion 420 raise relative to the board 104 (as shown in FIG. 16). With downward movement of the cap 106, the first support member 108 and the second support member 110 could be pressed directly by the cap 106 to rotate. In such a manner, the cap 106 could move to the pressed position as shown in FIG. 16 with rotation of the first support member 108 and the second support member 110, so that a protruding point 424 of the pressing arm portion 418 could trigger the switch 150 of the circuit board 148 for executing the corresponding input function. As for the other related description for the keyswitch 402, it could be reasoned by analogy according to the first embodiment and therefore omitted herein.

Figure 17:
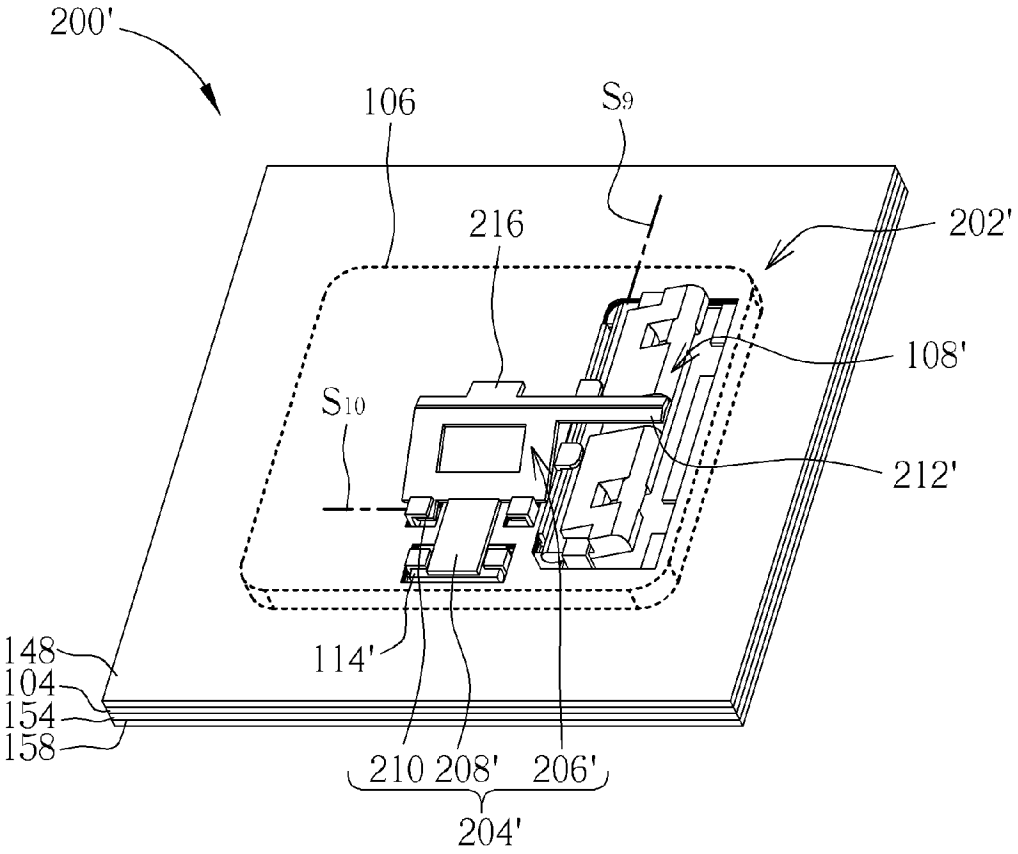
FIG. 17 is an assembly diagram of a keyswitch of a keyboard being assembled on the board according to a fifth embodiment of the present invention.

Please refer to FIG. 17, which is an assembly diagram of a keyswitch 202' of a keyboard 200' being assembled on the board 104 according to a fifth embodiment of the present invention. For clearly showing the structural design of the keyswitch 202', the cap 106 is omitted in FIG. 17. Components both mentioned in the fifth embodiment and the second embodiment represent components with similar functions or structures, and the related description is omitted herein. The major difference between the fifth embodiment and the second embodiment is that the keyswitch 202' only utilizes one support member to support the cap 106 for simplifying the mechanical design of the keyboard 200'. For example, as shown in FIG. 17, the keyboard 200' includes the board 104, the circuit board 148, the light guide plate 154, the magnetic plate 158, and the keyswitch 202'. The keyswitch 202' includes the cap 106, an attraction member 114', a support member 108', and a seesaw member 204'. The seesaw member 204' has the fulcrum portion 210, an attraction arm portion 208', and a pressing arm portion 206'. The attraction member 114' and the attraction arm portion 208' could be components which could generate an attraction force cooperatively to attract each other, such as a magnet and magnetic material (e.g. iron or other metal).

The support member 108' is rotatably connected to the cap 106 and rotatably connected to the board 104, so that the support member 108' could rotate around a rotating shaft $S_9$ on the board 104 to make the cap 106 movable between the non-pressed position and the pressed position relative to the board 104. The pressing arm portion 206' only has an abutting end 212'. The abutting end 212' is located between the support member 108' and the cap 106 for supporting the cap 106, but is not directly connected to the support member 108'. The fulcrum portion 210 is connected to the pressing arm portion 206' and the attraction arm portion 208', and is rotatably connected to the board 104 so that the fulcrum portion 210 could rotate around a rotating shaft $S_{10}$ on the board 104. In this embodiment, the fulcrum portion 210 could form a seesaw mechanism cooperatively with the pressing arm portion 206' and the attraction arm portion 208'. The rotating shaft $S_9$ of the support member 108' and the rotating shaft $S_{10}$ of the seesaw member 204' are substantially perpendicular to each other, and are arranged in an L-shape on the board 104 (as shown in FIG. 17).

Via the aforesaid design, when the cap 106 is pressed by an external force and the external force could overcome the attraction force between the attraction member 114' and the attraction arm portion 208', the cap 106 could directly press the abutting end 212' of the pressing arm portion 206' to drive the seesaw member 204' to rotate around the fulcrum portion 210 for making the attraction arm portion 208' raise relative to the board 104. With downward movement of the cap 106, the pressing arm portion 206' could utilize the abutting end 212' to press the support member 108' to rotate, so as to make the cap 106 move to the pressed position with rotation of the support member 108' for executing the corresponding input function. As for the other related description for the keyswitch 202', it could be reasoned by analogy according to the second embodiment and therefore omitted herein.

In summary, since there is no scissor mechanism and elastic member disposed in the keyboard provided by the present invention, the present invention could greatly reduce the overall space occupied by the keyswitch, so as to be advantageous to the thinning design of the keyboard and effectively prolong the life of the keyswitch.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch comprising:

a cap;

a board;

a first support member rotatably connected to the cap and rotatably connected to the board for rotating around a first rotating shaft on the board;

a second support member rotatably connected to the cap and rotatably connected to the board, the cap moving between a non-pressed position and a pressed position relative to the board with rotation of the first support member and the second support member;

a seesaw member having a pressing arm portion, a magnetic arm portion, and a fulcrum portion, the seesaw member movably supporting at least one of the cap, the first support member and the second support member, the fulcrum member being connected to the pressing arm portion and the magnetic arm portion and rotatably connected to the board, the seesaw member rotating around a second rotating shaft on the board, the second support member rotating around a third rotating shaft on the board; and a magnetic member disposed on the board corresponding to the magnetic arm portion;

wherein when the cap is pressed by an external force and the external force could overcome a magnetic attraction force between the magnetic member and the magnetic arm portion, the at least one of the cap, the first support member and the second support member moves downward to abut against the pressing arm portion for making the seesaw member rotate around the fulcrum portion, so that the magnetic arm portion could be driven to raise relative to the board and the cap could move from the non-pressed position to the pressed position; when the cap is released, the magnetic attraction force between the magnetic member and the magnetic arm portion drives the seesaw member to rotate around the fulcrum portion and then be absorbed onto the magnetic member for making the pressing arm portion raise relative to the board, so that the pressing arm portion could lift the at least one of the cap, the first support member and the second support member to make the cap move from the pressing position back to the non-pressed position.

2. The keyswitch of claim 1, wherein one of the magnetic member and the magnetic arm portion is a magnet, and the other one of the magnetic member and the magnetic arm portion is a magnet or is made of magnetic material.

3. The keyswitch of claim 1, wherein the pressing arm portion, the fulcrum portion, and the magnetic arm portion substantially form a T-shaped structure to make the pressing arm portion located between the first support member and the second support member, the pressing arm portion has a first abutting end and a second abutting end, the first abutting end abuts against the first support member or the cap, and the second abutting end abuts against the second support member or the cap.

4. The keyswitch of claim 3, wherein the pressing arm portion is made of magnetic material, the magnetic member is a magnet, the magnetic member extends toward the pressing arm portion to be partially overlapped with the pressing arm portion, and a magnetic attraction force between the pressing arm portion and the magnetic arm portion makes the cap speed up to the pressed position when the cap is pressed by the external force to make the pressing arm portion approach the magnetic member.

5. The keyswitch of claim 1, wherein the pressing arm portion, the fulcrum portion, and the magnetic arm portion substantially form a U-shaped structure to be located outside the first support member and the second support member, the pressing arm portion has a first abutting end and a second abutting end, the first abutting end abuts against the first support member or the cap, and the second abutting end abuts against the second support member or the cap.

6. The keyswitch of claim. 1, wherein the board further has a limiting arm portion, the first support member has a limiting block corresponding to the limiting arm portion, and the limiting arm portion is used for blocking the limiting block to limit a height of the cap relative to the board.

7. The keyswitch of claim 1 further comprising:

a light guide plate disposed under the board, the board having a plurality of holes; and a light emitting unit disposed at a side of the light guide plate for emitting light to pass through the plurality of holes via the light guide plate and then be emitted out of the cap.

8. The keyswitch of claim 1, wherein the first rotating shaft is substantially parallel to the third rotating shaft, the second rotating shaft is substantially perpendicular to the first rotating shaft and the third rotating shaft, and the first rotating shaft, the second rotating shaft, and the third rotating shaft are arranged in a U-shape on the board.

9. A keyboard comprising:

a board; and a plurality of keyswitches disposed on the board, at least one of the plurality of keyswitches comprising:

a cap;

a first support member rotatably connected to the cap and rotatably connected to the board;

a second support member rotatably connected to the cap and rotatably connected to the board, the cap moving between a non-pressed position and a pressed position relative to the board with rotation of the first support member and the second support member;

a seesaw member having a pressing arm portion, a magnetic arm portion, and a fulcrum portion, the seesaw member movably supporting at least one of the cap, the first support member, and the second support member, the fulcrum member being connected to the pressing arm portion and the magnetic arm portion and rotatably connected to the board; and a magnetic member disposed on the board corresponding to the magnetic arm portion;

wherein when the cap is pressed by an external force and the external force could overcome a magnetic attraction force between the magnetic member and the magnetic arm portion, the at least one of the cap, the first support member, and the second support member moves downward to abut against the pressing arm portion to make the seesaw member rotate around the fulcrum portion, so that the magnetic arm portion could be driven to raise relative to the board and the cap could be moved from the non-pressed position to the pressed position; when the cap is released, the magnetic attraction force between the magnetic member and the magnetic arm portion drives the seesaw member to rotate around the fulcrum portion and then be absorbed onto the magnetic member for making the pressing arm portion raise relative to the board, so that the pressing arm portion could lift the at least one of the cap, the first support member and the second support member to make the cap move from the pressing position back to the non-pressed position.

10. The keyboard of claim 9, wherein one of the magnetic member and the magnetic arm portion is a magnet, and the other one of the magnetic member and the magnetic arm portion is a magnet or is made of magnetic material.

11. The keyboard of claim 9, wherein the pressing arm portion, the fulcrum portion, and the magnetic arm portion substantially form a T-shaped structure to make the pressing arm portion located between the first support member and the second support member, the pressing arm portion has a first abutting end and a second abutting end, the first abutting end abuts against the first support member or the cap, and the second abutting end abuts against the second support member or the cap.

12. The keyboard of claim 11, wherein the pressing arm portion is made of magnetic material, the magnetic member is a magnet, the magnetic member extends toward the pressing arm portion to be partially overlapped with the pressing arm portion, and a magnetic attraction force between the pressing arm portion and the magnetic arm portion makes the cap speed up to the pressed position when the cap is pressed by the external force to make the pressing arm portion approach the magnetic member.

13. The keyboard of claim 9, wherein the pressing arm portion, the fulcrum portion, and the magnetic arm portion substantially form a U-shaped structure to be located outside the first support member and the second support member, the pressing arm portion has a first abutting end and a second abutting end, the first abutting end abuts against the first support member or the cap, and the second abutting end abuts against the second support member or the cap.

14. The keyboard of claim 13, wherein the first abutting end is made of magnetic material, the magnetic member extends toward the first abutting end to be partially overlapped with the first abutting end, and a magnetic attraction force between the magnetic member and the first abutting end makes the cap speed up to the pressed position when the cap is pressed by the external force to make the magnetic member approach the first abutting end.

15. The keyboard of claim 9, wherein the board further has a limiting arm portion, the first support member has a limiting block corresponding to the limiting arm portion, and the limiting arm portion is used for blocking the limiting block to limit a height of the cap relative to the board.

16. The keyboard of claim 9 further comprising:

a light guide plate disposed under the board; and a light emitting unit disposed at a side of the light guide plate for emitting light out of the cap via the light guide plate.

17. A keyboard comprising:

a board; and a plurality of keyswitches disposed on the board, at least one of the plurality of keyswitches comprising:

a cap;

a first support member rotatably connected to the cap and rotatably connected to the board for rotating around a first rotating shaft on the board, the cap moving between a non-pressed position and a pressed position relative to the board;

a seesaw member having a pressing arm portion, an attraction arm portion, and a fulcrum portion, the pressing arm portion movably supporting at least one of the cap and the first support member, the fulcrum member being connected to the pressing arm portion and the attraction arm portion and rotatably connected to the board to make the seesaw member rotate around a second rotating shaft on the board; and an attraction member disposed on the board corresponding to the attraction arm portion;

wherein when the cap is pressed by an external force and the external force could overcome a magnetic attraction force between the attraction member and the attraction arm portion, the pressing arm portion rotates around the fulcrum portion, so that the attraction arm portion could be driven to raise relative to the board and the cap could move from the non-pressed position to the pressed position with rotation of the first support member; when the cap is released, the magnetic attraction force between the attraction member and the attraction arm portion drives the attraction arm portion to rotate around the fulcrum portion and then be absorbed onto the attraction member for making the pressing arm portion raise relative to the board, so that the cap could move from the pressing position back to the non-pressed position with rotation of the first support member.

18. The keyboard of claim 17, wherein the first rotating shaft is substantially perpendicular to the second rotating shaft, and the first rotating shaft and the second rotating shaft are arranged in an L-shape on the board.

19. The keyboard of claim 17, wherein the pressing arm portion movably abuts against the cap but is not directly connected to the first support member, and the pressing arm portion drives the cap to move the first support member when the cap is released to move from the pressed position back to the non-pressed position.

20. The keyboard of claim 17, wherein the pressing arm portion is movably connected to the first support member but is not directly connected to the cap, and the pressing arm portion drives the first support member to move the cap when the cap is released to move from the pressed position back to the non-pressed position.

21. The keyboard of claim 17, wherein the pressing arm portion is movably connected to the first support member and the cap, and the pressing arm portion simultaneously drives the first support member and the cap to move when the cap is released to move from the pressed position back to the non-pressed position.

22. The keyboard of claim 17 further comprising:

a second support member rotatably connected to the cap and rotatably connected to the board for rotating around a third rotating shaft on the board, the cap moving between the non-pressed position and the pressed position with rotation of the second support member;

wherein the first rotating shaft is substantially parallel to the third rotating shaft.

23. The keyboard of claim 22, wherein the second rotating shaft is substantially perpendicular to the first rotating shaft and the third rotating shaft, the first rotating shaft, the second rotating shaft, and the third rotating shaft are arranged in a U-shape on the board, the pressing arm portion extends between the first support member and the second support member, the pressing arm portion is a T-shaped structure and has a first abutting end and a second abutting end extending in opposite directions respectively, the first abutting end is movably connected to the first support member, and the second abutting end is movably connected to the second support member.

24. The keyboard of claim 22, wherein the second rotating shaft is substantially perpendicular to the first rotating shaft and the third rotating shaft, the first rotating shaft, the second rotating shaft, and the third rotating shaft are arranged in a U-shape on the board, the pressing arm portion extends outside the first support member and the second support member, the pressing arm portion is a U-shaped structure and has a first abutting end and a second abutting end extending in opposite directions respectively from a terminal end of the U-shaped structure, the first abutting end is movably connected to the first support member, and the second abutting end is movably connected to the second support member.

25. The keyboard of claim 22 further comprising:

at least one linkage member rotatably connected to the cap and rotatably connected to the board for rotating around a fourth shaft on the board, the cap moving between the non-pressed position and the pressed position relative to the board with rotation of the linkage member;

wherein the first rotating shaft is parallel to the second rotating shaft and the third rotating shaft, the fourth rotating shaft is substantially perpendicular to the first rotating shaft, the second rotating shaft, and the third rotating shaft, and the fourth rotating shaft, the first rotating shaft, and the second rotating shaft are arranged in a U-shape on the board.

26. The keyboard of claim 17, wherein one of the attraction member and the attraction arm portion is a magnet, and the other one of the attraction member and the attraction arm portion is a magnet or is made of magnetic material.

* * * * *